US008092287B2

(12) United States Patent
Purvis et al.

(10) Patent No.: US 8,092,287 B2
(45) Date of Patent: Jan. 10, 2012

(54) SYSTEM AND METHOD FOR PROVIDING A REAL-TIME INTERACTIVE SURFACE

(75) Inventors: Christopher J. Purvis, La Crescenta, CA (US); Jonathan Michael Ackley, Glendale, CA (US)

(73) Assignee: Disney Enterprises, Inc., Burbank, CA (US)

( * ) Notice: Subject to any disclaimer, the term of this patent is extended or adjusted under 35 U.S.C. 154(b) by 574 days.

(21) Appl. No.: 12/315,803

(22) Filed: Dec. 4, 2008

(65) Prior Publication Data

US 2010/0144413 A1 Jun. 10, 2010

(51) Int. Cl.
*A63F 13/00* (2006.01)

(52) U.S. Cl. ..... 463/1; 463/2; 463/7; 463/32; 472/130

(58) Field of Classification Search ..... None
See application file for complete search history.

(56) References Cited

U.S. PATENT DOCUMENTS 5,405,152 A * 4/1995 Katanics et al. ..... 463/2
5,919,045 A 7/1999 Tagge
5,951,404 A 9/1999 Ohishi
6,007,338 A * 12/1999 DiNunzio et al. ..... 434/55
6,053,815 A 4/2000 Hara
6,297,814 B1 10/2001 Masuda
6,354,838 B1 3/2002 Tagge
6,494,784 B1 12/2002 Matsuyama
6,620,043 B1 * 9/2003 Haseltine et al. ..... 463/7
7,301,547 B2 11/2007 Martins
7,775,883 B2 * 8/2010 Smoot et al. ..... 463/36
7,843,455 B2 * 11/2010 Bridger et al. ..... 345/473
7,878,905 B2 * 2/2011 Weston et al. ..... 463/39
7,955,168 B2 * 6/2011 Mendelsohn et al. ..... 463/2
2003/0153374 A1 8/2003 Gilmore
2004/0224740 A1 11/2004 Ball
2005/0064936 A1 * 3/2005 Pryor ..... 463/36
2005/0266907 A1 * 12/2005 Weston et al. ..... 463/1

(Continued)

FOREIGN PATENT DOCUMENTS

WO WO0041156 7/2000

OTHER PUBLICATIONS

"Let's take a trip", Newsday (USA) / Nintendo World, May 13, 2008.

(Continued)

*Primary Examiner* — David Graybill
(74) *Attorney, Agent, or Firm* — Farjami & Farjami LLP

(57) ABSTRACT

Disclosed are systems and methods for providing a real-time interactive surface. In one embodiment, such a system comprises an activity surface for use as a venue for an interactive experience, and an interactive experience control unit including an events management application. The events management application is configured to monitor and coordinate events occurring during the interactive experience. The system also comprises a surface rendering application interactively linked to the events management application, the surface rendering application configured to render a visual image for display at the activity surface in real-time, the visual image corresponding to one or more visual assets associated with a subset of the events occurring during the interactive experience. The system further comprises a surface display module interactively linked to the surface rendering application, the surface display module configured to display the rendered real-time visual image at the activity surface to provide the real-time interactive surface.

20 Claims, 3 Drawing Sheets

U.S. PATENT DOCUMENTS

2005/0288100 A1 12/2005 Neervoort
2006/0030407 A1 2/2006 Thayer
2006/0196384 A1 9/2006 Faulcon
2007/0197285 A1 8/2007 Kamijo
2008/0096623 A1 4/2008 Fujii
2008/0125203 A1 5/2008 Sato
2010/0131947 A1 * 5/2010 Ackley et al. ..... 718/1

OTHER PUBLICATIONS

"A tangible game interface using projector-camera systems", National University of Singapore (NUS), dated Jul. 2007.

* cited by examiner

SYSTEM AND METHOD FOR PROVIDING A REAL-TIME INTERACTIVE SURFACE

BACKGROUND OF THE INVENTION

1. Field of the Invention

The present invention generally relates to displays and, more particularly, the present invention relates to interactive display surfaces.

2. Background Art

Leisure and entertainment destinations, such as theme parks and destination resorts, for example, are faced with the challenge of offering attractions that are desirable to a diverse general population in an increasingly competitive environment for securing the patronage of on-site visitors to recreational properties. One approach with which theme parks, for example, have responded to similar challenges in the past, is by diversifying the selection of attractions available to visitors. By offering a variety of attractions of different types, and even among attractions of a similar type, presenting those experiences using different themes, a wide spectrum of entertainment preferences may be catered to, broadening the potential appeal of the recreational property.

That this approach to meeting a variety of entertainment preferences has historically been successful is evidenced by the enduring popularity of Disneyland, Disney World, and other theme parks as vacation destinations. However, the advent of programmable portable entertainment products and devices, and the high degree of sophistication of the virtual recreation environments they support, have substantially raised consumer expectations concerning the level of real-time interactivity required for a recreational experience to be deemed stimulating and desirable. Moreover, the almost limitless variety of entertainment options made possible by modern electronic devices have raised public expectations regarding the level of personal selection and entertainment customizability to new heights as well.

As visitors to theme parks and other entertainment destinations begin to impose some of these heightened expectations on the attractions provided by those recreational locales, those properties may be forced to offer an ever greater variety of experiences in order to continue to provide the high level of entertainment satisfaction with which they have traditionally been identified. One conventional strategy for meeting that challenge is to increase the number and to continue to diversify the types of attractions provided on-site by a recreation property. Due to cost and resource constraints, however, there is a practical limit to how many distinct on-site attractions a single entertainment destination can support.

As a result, and in the face of greater consumer demand for real-time interactivity and individual choice, it may no longer suffice for an entertainment destination to offer a universal on-site experience to be commonly shared by all visitors, regardless of how artfully selected or designed that common experience may be. Consequently, in order to continue to provide the public with a high level of entertainment satisfaction, entertainment destinations such as theme parks may be compelled to find a way to provide real-time interactive experiences using their on-site attractions, as well as to utilize a single attraction venue to support a variety of distinct interactive experiences.

Accordingly, there is a need to overcome the drawbacks and deficiencies in the art by providing a solution enabling a user, such as a visitor to a theme park, to enjoy a real-time interactive experience from an on-site attraction. Moreover, it is desirable that the solution further enables the enhancement or customization of the real-time interactive experience to provide the user with a variety of distinct interactive experience options from a single on-site attraction venue.

SUMMARY OF THE INVENTION

There are provided systems and methods for providing a real-time interactive surface, substantially as shown in and/or described in connection with at least one of the figures, as set forth more completely in the claims.

BRIEF DESCRIPTION OF THE DRAWINGS

The features and advantages of the present invention will become more readily apparent to those ordinarily skilled in the art after reviewing the following detailed description and accompanying drawings, wherein.

DETAILED DESCRIPTION OF THE INVENTION

Figure 1:
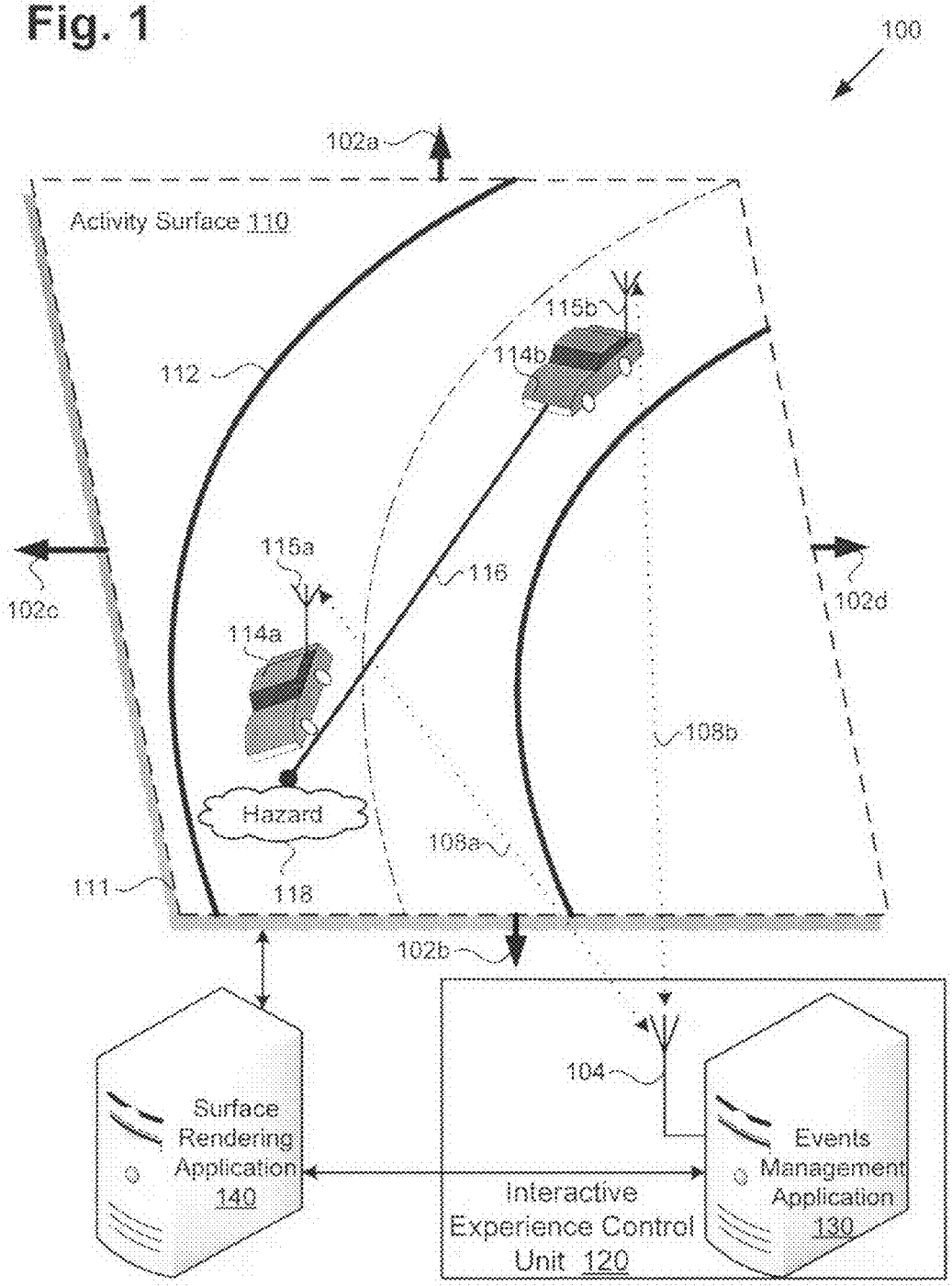
FIG. 1 shows a diagram of a specific implementation of a system for providing a real-time interactive surface, according to one embodiment of the present invention.

The present application is directed to a system and method for providing a real-time interactive surface. The following description contains specific information pertaining to the implementation of the present invention. One skilled in the art will recognize that the present invention may be implemented in a manner different from that specifically discussed in the present application. Moreover, some of the specific details of the invention are not discussed in order not to obscure the invention. The specific details not described in the present application are within the knowledge of a person of ordinary skill in the art. The drawings in the present application and their accompanying detailed description are directed to merely exemplary embodiments of the invention. To maintain brevity, other embodiments of the invention, which use the principles of the present invention, are not specifically described in the present application and are not specifically illustrated by the present drawings. It should be borne in mind that, unless noted otherwise, like or corresponding elements among the figures may be indicated by like or corresponding reference numerals.

FIG. 1 is a diagram of system 100 for providing a real-time interactive surface, according to one embodiment of the present invention. System 100, in FIG. 1, comprises activity surface 110, interactive experience control unit 120 including events management application 130, surface rendering application 140, and surface display module 111. FIG. 1 also shows race course 112, and hazard 118 produced by laser beam 116, which are displayed on activity surface 110. Also included in FIG. 1 are vehicles 114*a* and 114*b*. Vehicles 114*a* and 114*b*, which may be ride vehicles for use in a theme park ride, for example, are configured to move on activity surface 110. Moreover, as shown in FIG. 1, vehicles 114*a* and 114*b* may be interactively linked to events management application 130 through antenna 104, for example, by means of wireless communication links 108*a* and 108*b* to respective vehicle antennas 115*a* and 115*b*.

According to the embodiment of FIG. 1, activity surface 110, which may extend beyond the surface portion shown by the dashed perimeter, as indicated by arrows 102*a*, 102*b*,

102*c*, and 102*d*, may be used as a venue for a theme park attraction comprising the interactive experience, for example. More specifically, as in the embodiment of FIG. 1, activity surface 110 may be utilized to provide an interactive surface implemented as a ride surface for a theme park ride. Activity surface 110, which may by itself be a flat, neutral, featureless surface, for example, can be transformed by surface rendering application 140 and surface display module 111 to provide a real-time interactive display surface having display features determined by events management application 130. In the specific example shown in FIG. 1, for instance, activity surface 110 is transformed by surface rendering application 140 and surface display module 111 to produce a real-time interactive auto racing surface complete with race course 112 and special effects including hazard 118 and laser beam 116.

In other embodiments of system 100, activity surface 110 might be transformed into a winter snowscape, providing an appropriate ride environment for a snowmobile racing attraction, for example, or into an outer space environment appropriate for a space shooting game in which vehicles 114*a* and 114*b* may take the form of combat spacecraft. In an analogous manner, special effects produced on activity surface 110 by surface rendering application 140 and surface display module 111 may vary in theme according to the nature of the interactive experience. For example, hazard 118 may appear as a pothole or oil slick in the auto racing embodiment of FIG. 1, but be rendered as a patch of ice or open water in a snowmobile race, or as an asteroid or suspended explosive in an outer space shooting game.

Events management application 130, residing in interactive control unit 120, is configured to monitor and coordinate events occurring during the interactive experience taking place on activity surface 110. For example, in the embodiment of FIG. 1, events management application 130 may monitor events occurring on activity surface 110 through communication with vehicle client applications (not shown in FIG. 1) installed on vehicles 114*a* and 114*b*, and accessible through vehicle antennas 115*a* and 115*b*. In some embodiments, vehicles 114*a* and 114*b* may move in a controlled and predictable way along a fixed path, for example, as tracked vehicles on a predetermined ride track. In those embodiments, monitoring events occurring during the interactive experience may reduce to monitoring inputs provided by users of vehicles 114*a* and 114*b*, as recorded by the respective vehicle client applications, such as firing commands for laser beam 116 input by the user of vehicle 114*b*.

In some embodiments, however, the movement of vehicles 114*a* and 114*b* may be all or partially under the control of their respective users, who may have the power to determine the speed and/or direction of vehicles 114*a* and 114*b*. In those embodiments, for example, race course 112 may be provided as a guide to movement over activity surface 110, but the users of vehicles 114*a* and 114*b* may be able to deviate from race course 112. Under those circumstances, events management application 130 may be configured to track the respective positions of vehicles 114*a* and 114*b* on activity surface 110, that is to say their respective orientations in the plane of activity surface 110 and/or their locations on activity surface 110. Moreover, in some embodiments, events management application 130 may be configured to track the respective velocities, i.e. speeds and directions of motion, of vehicles 114*a* and 114*b* on activity surface 110.

It is noted that, more generally, when movement on activity surface 110 is not restricted to a predetermined or fixed path, vehicles 114*a* and 114*b* may be substituted by any suitable user accessories for tracking the activity of participants in the interactive experience. Thus, in some embodiments, participants in the interactive experience occurring on activity surface 110 may be outfitted with backpacks, footwear, headgear, or other equipment configured to host a client application and support interactive communication with events management application 130. Thus, regardless of the specific format of the interactive experience occurring on activity surface 110, events management application 130 may be configured to control and/or monitor and coordinate events occurring during the interactive experience.

As shown in FIG. 1, events management application 130 residing in interactive experience control unit 120 is interactively linked to surface rendering application 140. Surface rendering application 140 is configured to render one or more visual images for display at activity surface 110 in real-time, the rendered real-time visual images corresponding to visual assets associated with a subset of the events occurring during the interactive experience. For example, in the embodiment of FIG. 1, a particular event occurring during the interactive experience may be the firing of laser beam 116 by the user of vehicle 114*b*. As previously described, events management application 130 may track the positions and velocities of vehicles 114*a* and 114*b*, as well as monitor the fact that laser beam 116 has been fired from vehicle 114*b*. In addition, events management application 130 can determine the firing position of the laser gun fired from vehicle 114*b*, for example, from the position and velocity of vehicle 114*b* if the laser gun is in a fixed position on vehicle 114*b*, or from data provided by the client application running on vehicle 114*b* if the position of the laser gun is controlled by the user of vehicle 114*b*.

Consequently, events management application 130 can associate visual assets with the subset of events including the relative positions and velocities of vehicles 114*a* and 114*b*, the firing of laser beam 116 from vehicle 114*b*, and the firing position of the laser gun from which laser beam 116 is fired. For example, as shown in the embodiment of FIG. 1, events management application 130 may associate visual assets corresponding to a visible trajectory for laser beam 116 and hazard 118 created by the impact of laser beam 116 upon race course 112, with those events. Then, surface rendering application 140 may render the corresponding visual images for display at activity surface 110 in real-time. In addition, the ride system may cause physical manifestations of the visual events displayed on the surface display module 111. For example, if laser beam 116 is fired at such time as its trajectory intersects with vehicle 114*a*, interactive control unit 120 may cause ride vehicle 114*a* to physically spin around 360 degrees, shake up and down, or cause some other physical and/or audible feedback to occur.

The rendered display images may then be communicated to surface display module 111, which is interactively linked to surface rendering application 140. Surface display module 111 may be suitably configured to display the rendered real-time visual images rendered by surface rendering application 140, at activity surface 110, to provide the real-time interactive surface. Surface display module 111 may employ any suitable approach for providing a dynamic visual display at activity surface 110. For example, as in the embodiment shown by system 100, surface display module 111 may be configured to display the rendered real-time visual images at activity surface 110 from below the activity surface. In some of those embodiments, for instance, surface display module 111 may comprise one or more liquid crystal display (LCD) panels over which a substantially transparent structural activity surface 110 is placed. In some embodiments, surface display module 111 may be integrated with activity surface 110, so that the construction of activity surface 110 comprises surface display module 111. Alternatively, in some embodiments, surface display module 111 may be configured to display the rendered real-time visual images at activity surface 110 from above activity surface 110, such as by means of an overhead projection system, for example.

Thus, system 100, in FIG. 1, utilizes activity surface 110, events management application 130 residing on interactive control experience unit 120, surface rendering application 140, and surface display module 111 to provide a real-time interactive auto racing surface for the enjoyment of the users moving over activity surface 110 in vehicles 114*a* and 114*b*. In some embodiments, events management application 130 may be further configured to personalize the interactive experience occurring on activity surface 110 for one or more of the participants in the interactive experience, for example, according to an interaction history of the participant. The user's previous experiences may be input into interactive control unit 120in the form of user-specific metadata. This metadata could be generated by the ride system itself, or generated in another, external application. For instance, using the example of the auto racing attraction, the user could insert a "key" comprising a flash-memory device into the ride vehicle, which is portrayed as a racing car. This key device could be purchased from or provided by the theme park operator, and be configured to record the rider's "performance" each time they go on the attraction. This "key" could also be used in conjunction with a home-based computer game which is based on the story and theme of the in-park experience, where the user could also gain experience and status by playing the game at home against locally hosted AI or against other users via the internet. Based on this previous cumulative performance in the auto racing interactive experience shown in FIG. 1, the user of vehicle 114*b* may be provided with enhanced control over vehicle 114*b* and/or the laser gun producing laser beam 116, or have vehicle 114*b* equipped with additional or superior features compared to a neophyte user or a participant with a less accomplished interaction history. It is noted that although in the embodiment of FIG. 1, events management application 130 and surface rendering application are shown to be located on separate hardware systems, in other embodiments, they may reside on the same system.

Figure 2:
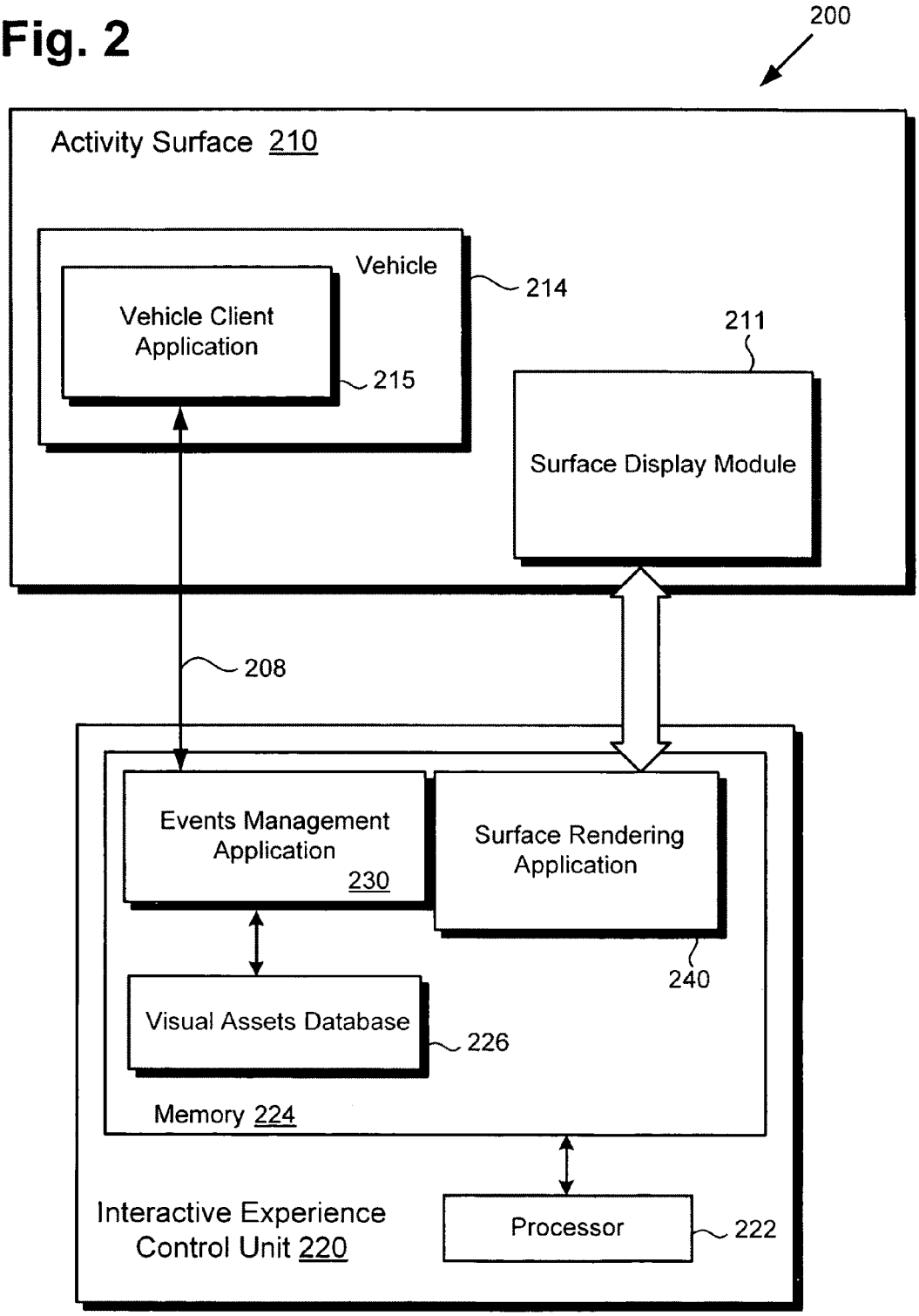
FIG. 2 shows a more abstract diagram of a system for providing a real-time interactive surface, according to one embodiment of the present invention.

Moving now to FIG. 2, FIG. 2 shows a more abstract diagram of a system for providing a real-time interactive surface, according to one embodiment of the present invention. As shown in the embodiment of FIG. 2, system 200 comprises activity surface 210 and interactive experience control unit 220, corresponding respectively to activity surface 110 and interactive experience control unit 120, in FIG. 1. Activity surface 210, in FIG. 2, is shown in combination with vehicle 214 and surface display module 211, corresponding respectively to either of vehicles 114*a* or 114*b* and surface display module 111, in FIG. 1. Vehicle 214, in FIG. 2, is shown to include vehicle client application 215, which is discussed in conjunction with FIG. 1, but is not specifically shown in system 100.

Interactive experience control unit 220 includes memory 224 and processor 222. Also shown in FIG. 2 are events management application 230 interactively linked to vehicle client application 215, and surface rendering application 240 interactively linked to surface display module 211, corresponding respectively to events management application 130, and surface rendering application 140, in FIG. 1. Communication link 208, in FIG. 2, connecting events management application 230 with vehicle client application 215 may be a wired or wireless communication link, and corresponds to either of wireless communication links 108*a* or 108*b*, in FIG. 1. According to the embodiment of system 200, events management application 230 and surface rendering application 240 reside together in memory 224, although as explained previously, in other embodiments events management application 230 and surface rendering application 240 may be stored apart from each other on separate memory systems. In addition, memory 224 includes visual assets database 226, referred to impliedly in the discussion surrounding FIG. 1, but not explicitly named or shown in conjunction with that figure.

In one embodiment, interactive experience control unit 220 may comprise a server configured to support the interactive experience taking place on activity surface 110. In that embodiment, for example, processor 222 may correspond to a central processing unit (CPU) of interactive experience control unit 220, in which role processor 222 may run the operating system of interactive control unit 220. In addition, processor 222 may be configured to facilitate communications between interactive control unit 220, vehicle client application 215, and surface display module 211, as well as to control execution of events management application 230 and surface rendering application 240.

The systems of FIG. 1 and FIG. 2 will be further described with reference to FIG. 3, which presents a method for providing a real-time interactive surface, according to one embodiment of the present invention. Certain details and features have been left out of flowchart 300 that are apparent to a person of ordinary skill in the art. For example, a step may consist of one or more substeps or may involve specialized equipment or materials, as known in the art. While steps 310 through 360 indicated in flowchart 300 are sufficient to describe one embodiment of the present method, other embodiments may utilize steps different from those shown in flowchart 300, or may include more, or fewer steps.

Figure 3:
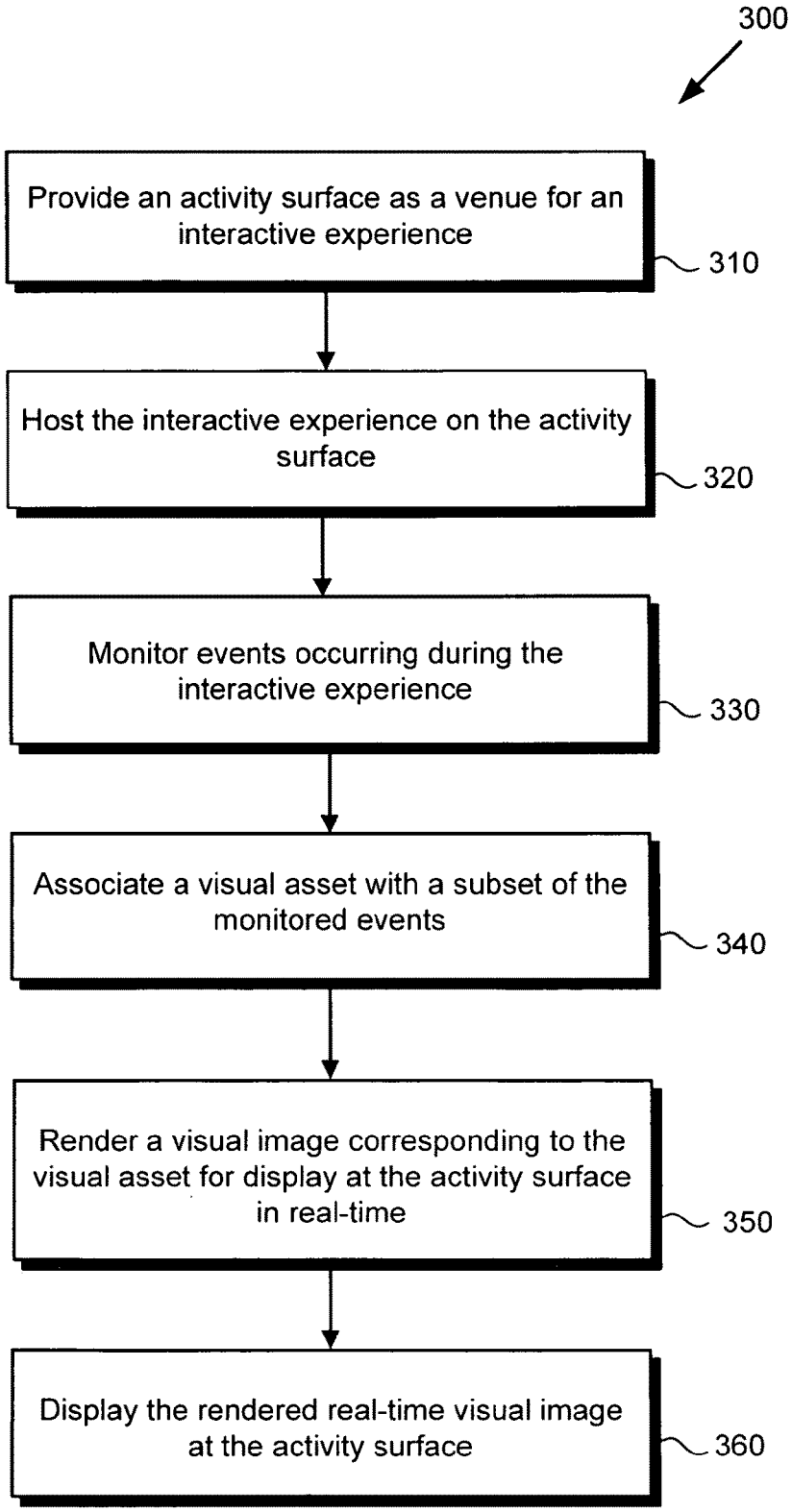
FIG. 3 is a flowchart presenting a method for providing a real-time interactive surface, according to one embodiment of the present invention.

Beginning with step 310 in FIG. 3 and referring to FIGS. 1 and 2, step 310 of flowchart 300 comprises providing activity surface 110 or 210 as a venue for an interactive experience. Step 310 may be performed by either of respective systems 100 or 200 shown in FIGS. 1 and 2. As discussed in relation to FIG. 1, in one embodiment, providing activity surface 110 as the venue for an interactive experience may comprise using activity surface 110 as the venue for a theme park attraction comprising the interactive experience. As a specific example of that latter embodiment, step 310 may correspond to using activity surface 110 as a ride surface for a theme park ride, such as the interactive auto racing ride shown in FIG. 1.

Continuing with step 320 of flowchart 300 by reference to FIG. 1, step 320 comprises hosting the interactive experience on activity surface 110. Step 320 may be performed by events management application 130 on interactive experience control unit 120, and may correspond to providing an appropriate predetermined sequence of events and/or display environment for the interactive experience. In the case of the auto racing ride shown in FIG. 1, for example, hosting the interactive experience may comprise providing visual imagery transforming activity surface 110 into an auto racing environment through display of race course 112 and other environmental cues consistent with an auto racing theme. Environmental cues may include sights and/or sounds and/or odors and/or tactile sensations, for example, consistent with the experience of auto racing.

Moving on to step 330 of flowchart 300, step 330 comprises monitoring events occurring during the interactive experience. Referring to FIG. 2, step 330 may be performed by events management application 230. Where, as in FIG. 2, the interactive experience includes use of vehicle 214, monitoring events occurring during the interactive experience may comprise receiving and interpreting data provided by vehicle client application 215, such as data corresponding to vehicle position, vehicle velocity, and/or actions performed by an interactive experience participant using vehicle 214. More generally, where the interactive experience does not include use of vehicle 214 or an analogous transport subsystem, monitoring of events occurring during the interactive experience may be performed by events management application 230 in communication with a client application running on devices or equipment utilized by the participants in the interactive experience. Such devices or equipment might comprise communication devices synchronize to communicate with events management application 230, or suitably configured items of footwear, headgear, or backpacks, for example.

Flowchart 300 continues with step 340, comprising associating at least one visual asset with a subset of the monitored events occurring during the interactive experience. Consulting FIG. 2 once again, step 340 may be performed by events management application 230 by reference to visual assets database 226. Step 340 may correspond, for example, to selection of an oil slick or pot hole as hazard 118, in FIG. 1, associated with the subset of events related to the firing of laser beam 116 from vehicle 114*b* in that figure.

Progressing now to step 350 of flowchart 300 and referring to both FIGS. 1 and 2, step 350 comprises rendering a visual image corresponding to the at least one visual asset for display at activity surface 110 or 210 in real-time. Step 350 may be performed by surface rendering application 140 or 240 in response to criteria provided by events management application 130 or 230, to which respective surface rendering applications 140 and 240 are interactively linked. The rendered real-time visual image is then displayed at the activity surface by surface display module 111 or 211 in step 360 of flowchart 300, thereby providing the real-time interactive surface. As previously described, in some embodiments displaying the rendered real-time visual image or images at the activity surface in step 360 comprises displaying the rendered real-time visual image or images from below activity surface 110 or 210, while in other embodiments step 360 comprises displaying the rendered real-time visual image or images from above the activity surface.

Although not described in the method of flowchart 300, in some embodiments, a method for providing a real-time interactive surface may further comprise providing a vehicle configured to move on the activity surface during the interactive experience. In those embodiments, providing the vehicle may comprise providing a theme park ride vehicle, such as vehicles 114*a* and 114*b*, in FIG. 1, for use in a theme park ride performed on activity surface 110. In some embodiments, moreover, the present method may further include tracking the position and/or the velocity of the vehicle on the activity surface.

In one embodiment, the method of flowchart 300 may further comprise personalizing the interactive experience for a participant in the interactive experience, according to an interaction history of the participant. As described previously in relation to FIG. 1, personalizing the interactive experience may include providing the participant with enhanced control over a ride vehicle, or equipping the participant or their vehicle with special or superior equipment based on their record of previous participation in the interactive experience. Alternatively, personalization may reflect the personal preference of the participant. For example, a particular participant may prefer a certain model and/or color of race car for use as a ride vehicle in the auto racing interactive experience shown in FIG. 1. Personalizing the interactive experience according to an interaction history reflective of those preferences may result in adaptation of the interactive experience environment to provide the desired effects.

Thus, the present application discloses a system and method providing a real-time interactive surface enabling a user, such as a visitor to a theme park, to enjoy a real-time interactive experience from an on-site attraction. In addition, the disclosed system and method further enable the enhancement or personalization of the real-time interactive experience to provide the user with a variety of distinct interactive experience options from a single on-site attraction venue. From the above description of the invention it is manifest that various techniques can be used for implementing the concepts of the present invention without departing from its scope. Moreover, while the invention has been described with specific reference to certain embodiments, a person of ordinary skill in the art would recognize that changes can be made in form and detail without departing from the spirit and the scope of the invention. It should also be understood that the invention is not limited to the particular embodiments described herein, but is capable of many rearrangements, modifications, and substitutions without departing from the scope of the invention.

What is claimed is:

1. A system for providing a real-time interactive surface, the system comprising:

an activity surface for use as a venue for an interactive experience;

an interactive experience control unit including an events management application, the events management application configured to monitor and coordinate events occurring during the interactive experience;

a surface rendering application interactively linked to the events management application, the surface rendering application configured to render a visual image for display at the activity surface in real-time, the rendered real-time visual image corresponding to at least one visual asset associated with a subset of the events occurring during the interactive experience; and a surface display module interactively linked to the surface rendering application, the surface display module configured to display the rendered real-time visual image at the activity surface to provide the real-time interactive surface.

2. The system of claim 1, wherein the activity surface is used as the venue for a theme park attraction comprising the interactive experience.

3. The system of claim 1, wherein the real-time interactive surface is implemented as a ride surface for a theme park ride.

4. The system of claim 1, further comprising a vehicle interactively linked to the events management application, the vehicle configured to move on the activity surface.

5. The system of claim 4, wherein the events management application is further configured to track a position of the vehicle on the activity surface.

6. The system of claim 4, wherein the events management application is further configured to track a velocity of the vehicle on the activity surface.

7. The system of claim 1, wherein the surface display module is configured to display the rendered real-time visual image at the activity surface from above the activity surface.

8. The system of claim 1, wherein the surface display module is configured to display the rendered real-time visual image at the activity surface from below the activity surface.

9. The system of claim 1, wherein the surface display module is integrated with the activity surface, so that the activity surface comprises the surface display module.

10. The system of claim 1, wherein the events management application is further configured to personalize the interactive experience for a participant in the interactive experience according to an interaction history of the participant.

11. A method for providing a real-time interactive surface, the method comprising:

providing an activity surface as a venue for an interactive experience;

hosting the interactive experience on the activity surface;

monitoring events occurring during the interactive experience;

associating at least one visual asset with a subset of the monitored events occurring during the interactive experience;

rendering a visual image corresponding to the at least one visual asset for display at the activity surface in real-time; and displaying the rendered real-time visual image at the activity surface, thereby providing the real-time interactive surface.

12. The method of claim 11, wherein providing the activity surface as the venue for the interactive experience comprises using the activity surface as the venue for a theme park attraction comprising the interactive experience.

13. The method of claim 11, wherein providing the activity surface as the venue for the interactive experience comprises using the activity surface as a ride surface for a theme park ride.

14. The method of claim 11, further comprising providing a vehicle configured to move on the activity surface during the interactive experience.

15. The method of claim 14, wherein providing the vehicle comprises providing a theme park ride vehicle for use in a theme park ride performed on the activity surface.

16. The method of claim 14, further comprising tracking a position of the vehicle on the activity surface.

17. The method of claim 14, further comprising tracking a velocity of the vehicle on the activity surface.

18. The method of claim 11, wherein displaying the rendered real-time visual image at the activity surface comprises displaying the rendered real-time visual image from above the activity surface.

19. The method of claim 11, wherein displaying the rendered real-time visual image at the activity surface comprises displaying the rendered real-time visual image from below the activity surface.

20. The method of claim 11, further comprising personalizing the interactive experience for a participant in the interactive experience according to an interaction history of the participant.

* * * * *